United States Patent [19]

Janko et al.

[11] Patent Number: 4,623,819

[45] Date of Patent: Nov. 18, 1986

[54] ACCELERATING AND SCAN EXPANSION ELECTRON LENS MEANS FOR A CATHODE RAY TUBE

[75] Inventors: Bozidar Janko, Portland; Norman R. Franzen, Tigard; Myron A. Bostwick, Jr., Banks, all of Oreg.

[73] Assignee: Tektronix, Inc., Beaverton, Oreg.

[21] Appl. No.: 764,519

[22] Filed: Aug. 12, 1985

Related U.S. Application Data

[63] Continuation of Ser. No. 453,447, Dec. 27, 1982, abandoned.

[51] Int. Cl.[4] ..... H01J 29/74; H01J 29/46

[52] U.S. Cl. ..... 313/432; 313/449; 315/17

[58] Field of Search ..... 313/432, 436, 439, 449, 313/460; 315/15, 17

[56] References Cited

U.S. PATENT DOCUMENTS

| | | | |
|---|---|---|---|
| 2,412,687 | 12/1946 | Klemperer | 313/460 |
| 3,023,336 | 2/1962 | Frenkel | 313/78 |
| 3,496,406 | 2/1970 | Deschamps | 313/429 X |
| 3,792,303 | 1/1974 | Albertin | 315/17 |
| 4,137,479 | 1/1979 | Janko | 313/426 |
| 4,142,128 | 2/1979 | Odenthal | 315/15 |
| 4,188,563 | 2/1980 | Janko | 313/460 |

FOREIGN PATENT DOCUMENTS

| | | |
|---|---|---|
| 601948 | 5/1948 | United Kingdom . |
| 1067477 | 5/1967 | United Kingdom . |
| 1227828 | 4/1971 | United Kingdom . |
| 1299285 | 12/1972 | United Kingdom . |

OTHER PUBLICATIONS

O. Klemperer, *Electron Optics*, pp. 100–106, (3rd ed. Cambridge University Press, 1971).

A. Martin and J. Deschamps, *A Short Length Rectangular Oscilloscope Tube with High Deflection Sensitivity by using an Original Technique*, 12 Proceedings of the Society for Information Display, 18(1st Qtr, 1971), pp. 16–21.

*Primary Examiner*—Palmer C. DeMeo
*Assistant Examiner*—Sandra L. O'Shea
*Attorney, Agent, or Firm*—John D. Winkelman; Paul S. Angello

[57] ABSTRACT

A post-deflection accelerating and scan expansion lens system (10) is disclosed which may be used in a cathde ray tube (12). The lens system comprises an accelerating and scan expansion lens (70) of the quadrupole type including a pair of coaxial cylindrical electrodes (72, 74) and first and second compensating lenses (66, 78) on opposite ends thereof to provide a bright image of the desired size in sharp focus and great detail on a fluorescent screen in such tube. The first compensating lens (66) is supported adjacent the input of the accelerating and scan expansion lens to provide a linear magnification of the amount of electron beam deflection produced by the vertical and horizontal deflection plates (46, 48 and 50, 52). The second compensating lens (78) includes a single electrode having an aperture (79) with opposed notches (122, 124) in the edge of the aperture on opposite sides of the electron beam axis (28) and is positioned adjacent the output of the accelerating and scan expansion lens to provide corrected geometry of the image displayed on the fluorescent screen.

18 Claims, 7 Drawing Figures

ACCELERATING AND SCAN EXPANSION ELECTRON LENS MEANS FOR A CATHODE RAY TUBE

This is a continuation of application Ser. No. 453,447 filed Dec. 27, 1982 and now abandoned.

TECHNICAL FIELD

This invention relates to electrostatic post-deflection accelerating and scan expansion lens systems, and in particular, to such a lens system included in a cathode ray tube in which the lenses provide linear magnification of the electron beam deflection angle and corrected geometry of the image displayed on the fluorescent screen of such tube.

BACKGROUND OF THE INVENTION

A post-deflection accelerating and scan expansion lens system is included in a cathode ray tube to perform two distinct functions. The lens system magnifies the amount of electron beam deflection produced by the deflection means to provide an image of the desired size on the fluorescent screen. The lens system also increases the velocity of the electrons in the electron beam by means of a high intensity electric field to raise the energy of the electrons and thereby produce a brighter image on the fluorescent screen.

A number of accelerating and scan expansion lens systems make use of a focusing lens of the quadrupole type. For an electron beam traveling toward a fluorescent screen in the Z direction and deflected horizontally in the X direction and vertically in the Y direction of a three dimensional Cartesian coordinate system, a quadrupole lens converges with respect to its principal axis the beam in one of the X-Z and Y-Z planes and diverges it in the other one of the planes. The particular planes of convergence and divergence are determined by the distribution of the voltages applied to the quadrupole lens electrodes. Thus, the paths of deflected electron beams traveling in the Z direction and converging in the Y-Z plane are brought to a line focus parallel to the X axis. To obtain a point focus of the electron beam on the fluorescent screen and thereby produce an image in sharp focus and great detail, a post-deflection lens system incorporating a quadrupole lens operating in the manner described requires the use of a second quadrupole lens which converges the electron beam in the Y-Z plane and diverges it in the X-Z plane.

Two distinct distortion mechanisms associated with quadrupole accelerating and scan expansion lens systems deform the image displayed on the fluorescent screen. These include nonlinear magnification of the beam deflection angle and the "pincushion" type of geometry distortion. Nonlinear magnification of the beam deflection angle is produced by the nonuniform influence of the electric field flux lines of the lens system on the direction of beam travel. The electric field expands the scan deflection angle of the beam to produce a corresponding light image of the desired size on the fluorescent screen, Generally, in lens systems of this type, an electron beam which is deflected to a great degree is not magnified in the same proportion relative to a beam deflected to a substantially lesser degree. For example, a low voltage sine wave represented in the time domain would appear on a fluorescent screen as being frequency modulated at the end points of the display because the nonlinear effects of scan expansion on the time base sweep would produce zero crossings at the ends of the sign wave image which would be different from the uniform spacing of the zero crossings at the center portion of the display.

Geometry distortion of the displayed image is caused by aberrations in the shape of the electric field flux lines in the space above and below the lens axis. The electric field flux line pattern developed in the X-Y plane in a quadrupole lens system is characterized generally as having a plurality of parallel horizontal lines disposed transversely of an electron beam traveling along the Z axis. Moderate fluctuations in the flux lines produce geometry distortion of the image. Such distortion is characterized by deformations in an image of intended rectangular form which is displayed as having stretched vertices and concave side portions. An intolerable degree of geometry distortion of an image generally is introduced in short length cathode ray tubes wherein the quadrupole accelerating lens with a short focal length provides a high intensity electric field for electron beam deflection angle magnification.

A short length cathode ray tube is a tube that performs comparably to a tube of standard length but has an overall length of about five centimeters less than the standard length.

The basic principles underlying the operation of electrostatic lenses for focusing electron beams produced in electron discharge devices are described in U.S. Pat. No. 2,412,687 of Klemperer. The Klemperer patent teaches the formation of an electron lens that makes use of a pair of aligned tubular electrodes maintained at different potentials to converge an electron beam toward the electrode which is held at a more positive potential. One lens system described by the Klemperer patent includes two overlapping coaxial cylindrical electrodes with portions projecting from the end of the smaller diameter electrode being embraced by the larger diameter electrode. The Klemperer patent does not suggest the use of such lens systems for acceleration of a deflected electron beam and, therefore, does not disclose compensating means for correcting nonlinear magnification of the amount of deflection of the beam and geometry distortion of the corresponding light image displayed on a fluorescent screen.

A quadrupolar accelerating electrostatic lens system which includes a "lipped" cylindrical tube protruding into a wider tube, such as the conductive wall coating on the neck of a cathode ray tube envelope, is described in O. Klemperer, *Electron Optics,* 100–106 (3d ed. Cambridge University Press, 1971). In *Electron Optics,* Klemperer discusses in general the parameters associated with focusing an electron beam for accomplishing scan magnification to produce increased deflection of an electron beam, but does not address the problems of nonlinear scan expansion of the electron beam or geometry distortion of the image displayed on a fluorescent screen.

U.S. Pat. No. 3,496,406 of Deschamps describes a cathode ray tube having an electrostatic lens system that includes a quadrupole scan expansion lens disposed within a dome-shaped post-deflection acceleration electrode having a slot at its apex. The dome-shaped electrode is positioned to enclose the portion of the quadrupole lens facing the funnel portion of the cathode ray tube envelope that bears a conductive coating to which is applied the accelerating potential. The dome-shaped electrode is held at ground potential, thereby providing a shield to isolate the quadrupole lens from the effects of the intense electric field developed between the dome-shaped electrode and the conductive coating on the inner surface of the tube. This combination of the scan expansion quadrupole lens and the dome-shaped electrode constitutes a lens system which causes the electron beam paths to cross over in the vertical plane and the electrons to be accelerated toward the fluorescent screen after they exit the slot in the dome-shaped electrode.

A discussion of the operation of and the mathematical expressions relating to a short length cathode ray oscilloscope tube having a quadrupole scan expansion lens in conjunction with a dome-shaped electrode accelerating system of the type disclosed in the Deschamps patent is described in A. Martin & J. Deschamps, *A Short Length Rectangular Oscilloscope Tube With High Deflection Sensitivity By Using an Original Iechnique,* 12 Proceedings of the Society for Information Display 18 (1st Qtr. 1971). However, there is no disclosure of a compensating means for correcting distortion of the image displayed on the screen.

U.S. Pat. No. 3,792,303 of Albertin, et al. describes a modification of the Deschamps lens system in an attempt to correct for distortion of the displayed image. Albertin, et al. increases the length of the sides of the dome-shaped electrode to cover all but one side of the quadrupole scan expansion lens. A single disk-shaped slot electrode is disposed perpendicular to the electron beam axis on each end of the quadrupole lens. The first slot electrode is positioned inside the dome-shaped electrode beyond the quadrupole lens and in front of the slot in the dome-shaped electrode. This slot electrode is physically and electrically connected to the dome-shaped electrode so that both electrodes are at ground potential. The second slot electrode is positioned adjacent the edge of the base portion of the dome-shaped electrode in front of the quadrupole lens and is electrically isolated so that it can be raised to a voltage which is different from that of the first slot and dome-shaped electrodes.

A disk-shaped electrostatic screen or shield electrode having a conventional rectangular slot is held at ground potential and is placed immediately in front of the second slot electrode of Albertin, et al. The screen electrode and dome-shaped electrode substantially fully enclose the quadrupole lens within an equipotential space at ground potential.

Albertin, et al. describes a compensation technique which is said to correct for image distortion by separating into horizontal and vertical components the combined effects of scan nonlinearity and geometry distortion. The geometry of the aperture of the first slot electrode included within the dome-shaped electrode is determined experimentally to correct for distortions which appear on the screen and are introduced by the horizontal deflection of the electron beam during scanning. The geoxetry of the aperture of the second slot electrode positioned in front of the quadrupole lens is determined experimentally in conjunction with a suitable applied potential to correct for distortions which appear on the screen and are introduced by the vertical deflection of the electron beam during scanning. In addition, the voltage applied to the second slot electrode affects the performance of the first slot electrode. Thus, the geometry of the aperture of the first slot electrode corrects for distortion introduced by not only the horizontal electron beam trace, but also the presence of the second slot electrode.

This compensation technique suffers from a disadvantage in that experimental adjustments for the horizontal and vertical image distortion components are not independent. Thus, the aperture size and the voltage applied to the second slot electrode affect the aperture size and compensating electric field produced by the first slot electrode.

U.S. Pat. Nos. 4,137,479 and 4,188,563 of Janko describe a cathode ray tube having a post-deflection quadrupole lens system which, unlike the quadrupole lenses disclosed in Deschamps and Albertin, et al., simultaneously expands the deflection scan of the electron beam and accelerates the electrons toward the fluorescent screen. The Janko lens system includes a pair of aligned tubular entrance and exit electrodes of the same diameter, the adjacent ends of which are spaced apart with an air gap therebetween and have interdigitated sections that describe complementary curvilinear courses along the peripheries of the electrodes. The accelerating electric field is produced by connecting the entrance electrode to ground potential and applying the acceleration voltage to the exit electrode which is electrically connected to the conductive coating on the funnel portion of the tube. An octupole lens system is positioned in front of and adjacent to the entrance electrode to correct for both nonlinear scan magnification of the electron beam and geometry distortion of the displayed image. Janko also suggests an alternative embodiment which utilizes a pair of coaxial tubular electrodes of different diameters with the outer electrode encompassing the curvilinear edge portions of the inner electrode.

The Janko lens system of aligned tubular electrodes of the same diameter preceded by an octupole distortion correction lens is of limited utility as an accelerating lens because of a tendency of dielectric breakdown to occur in the air gap between the electrodes. Since a potential difference of about 23 kv is applied between the electrodes, the adjacent edges of each electrode must be smoothed to eliminate sharp edge points of microscopic dimensions which tend to produce excessively high electric field strengths that cause field emission of electrons which form an electric arc between the electrodes.

The coaxial lens system of the alternative embodiment suggested by Janko is less susceptible to dielectric breakdown, but it has the inherent characteristic of producing a weaker lens which provides less scan magnification of the electron beam deflection angle. In general, for a given applied voltage, the focal length of such a lens is directly proportional to the diameter of the inner electrode. Thus, an inner electrode of relatively small diameter is required to produce a strong lens with a short focal length. A strong scan expansion lens enhances geometry distortion effects, and it has been determined empirically that the Janko coaxial accelerating lens operating with an octupole correction lens produces geometry distortion to an unacceptable degree for inner electrode diameters of less than 1.905 centimeters. Thus, the Janko coaxial lens system is not suitable for use in short length cathode ray tubes, in which strong scan expansion lenses with short focal lengths are required.

U.S. Pat. No. 4,142,128 of Odenthal describes a cathode ray tube provided with a rectangular box-shaped scan expansion lens which includes at least four tubular elements disposed end-to-end and spaced apart to isolate them electrically. The tubular elements have bias voltages of different values that change the lens characteristics. Distortion of the image due to nonlinear scan expansion is corrected by the inclusion of additional side plates to which a differential bias voltage is applied.

U.S Pat. No. 3,023,336 of Frenkel describes a cathode ray tube in which post-deflection acceleration and scan expansion is accomplished by a combination of an electrostatic accelerating and converging lens with a magnetic converging lens which create spherical aberrational effects that compensate for each other to project an image in sharp detail on a fluorescent screen.

SUMMARY OF THE INVENTION

One object of this invention is to provide a post-deflection accelerating electrostatic lens system which accelerates an electron beam after deflection of such beam and provides deflection scan expansion with low distortion.

Another object of this invention is to provide such a lens system including a pair of overlapping coaxial lens electrodes forming an accelerating and scan expansion lens and two compensating slot lenses employed in cooperation with the accelerating and scan expansion lens to independently provide for linear magnification of the electron beam deflection angle and corrected geometry of the image.

A further object of this invention is to provide such a lens system in a cathode ray tube which operates at a relatively low gun voltage to accomplish strong scan magnification of an electron beam and sufficient electron acceleration to produce a bright, distortion-free light image of the desired size on the fluorescent screen of such tube.

Still another object of this invention is to provide in a short length cathode ray tube such a post-deflection acceleration and scan expansion lens system which includes a pair of coaxial accelerating and scan expansion electrodes of different diameters and produces with the inner electrode of relatively small diameter an electron image which is free from geometry distortion.

Yet another object of the invention is to provide such a lens system which reduces the tendency of field emission of electrons from the lens electrodes.

The present invention relates to an electrostatic lens system which may be included in an electron discharge device, such as a cathode ray tube, having an electron gun that produces a beam of electrons directed along a beam axis in the tube and deflection means for deflecting such beam. The lens system is positioned after the deflection means along the beam axis and comprises slot lens means including a plurality of apertured slot electrodes having slots symmetrically aligned about the beam axis. An accelerating and scan expansion lens means including two aligned cooperating tubular electrodes of different diameters is supported downstream of the slot lens means to provide in cooperation with the slot lens means a linear magnification of the amount of electron beam deflection produced by the deflection means. An exit lens means including an exit lens electrode supported adjacent the output of the accelerating and scan expansion lens means and having a slot aperture with a pair of opposed notches provides corrected geometry of the image on the display screen of the cathode ray tube.

The particular accelerating and scan expansion lens system disclosed herein by way of example operates at relatively low voltage and produces a bright image of the desired size in sharp focus and great detail on a fluorescent screen. Conventional cathode ray tubes having post-deflection acceleration and scan expansion lens systems typically require a potential difference of about 23 kv measured between the cathode of the electron gun and the conducting layer on the fluorescent screen to obtain a sharp focused image of high brightness comparable to that achieved in the present invention with a lower potential difference of 16 kv. The lens system of the present invention utilizes a pair of coaxial electrodes of different diameters including an inner electrode having a relatively small diameter of less than or equal to 1.905 centimeters to produce a lens of the quadrupole type with increased electron beam magnification and a short focal length. The advantages of a lens system of this type include its suitability for use in short length cathode ray tubes and a reduced tendency for field emission of electrons from such electrodes causing dielectric breakdown in the air gap between the electrodes. The latter advantage is due to the overlapping coaxial positioning of the electrodes and the operation at a lower voltage. It will be understood that the present invention can also be incorporated in standard length cathode ray tubes.

Accelerating lenses that have overlapping coaxial electrodes heretofore have operated successfully only with inner electrodes having relatively large diameters. As the diameter of the inner electrode is reduced below 1.905 centimeters, geometry distortion effects on the image cannot be adequately corrected. Thus, a coaxial tubular electrode lens with an octupole distortion compensating lens of the type disclosed by the Janko patents is useful for only cathode ray tubes of relatively long lengths because of the constraint of a minimum diameter for the inner electrode.

An interdigitated electrode lens of the type disclosed by Janko that includes two tubular electrodes of the same diameter is not suitable for use in short length cathode ray tubes. The interdigitated electrode lens requires a higher voltage to increase lens magnification and thereby shorten the focal length. The increased voltage, however, enhances to an unacceptable degree the likelihood of field emission of electrons.

The compensating lens system of the present invention allows an accelerating and scan expansion lens having a pair of overlapping coaxial electrodes of different diameters to operate successfully in short length cathode ray tubes. The compensating lens system operates in communication with the accelerating and scan expansion lens means and comprises first and second compensating lenses. The first lens is positioned adjacent the front end of the accelerating and scan expansion lens means and includes six closely spaced-apart wafer-like slot lens electrodes having apertures symmetrically aligned about the beam axis. A DC bias voltage is applied and distributed to certain ones of the slot lens electrodes to produce electric field flux lines that influence the vertical direction of travel of an electron beam deflected to a great degree by the deflection means so as to provide a linear vertical magnification of the amount of beam deflection. The second lens is positioned adjacent the rear end of the accelerating and scan expansion lens means and comprises a single exit electrode having an elongated slot aperture with a pair of opposed arcuate cutout portions or notches in the longer edges of the slot on opposite sides of the beam axis. This second lens produces an electric field pattern having a flux line shape and distribution which is similar to that of the accelerating and scan expansion lens means but with oppositely phased fluctuations. The superposition of these two electric fields effectively eliminates geometry distortion of the displayed image.

Each of the two compensating lenses is physically separate from and functionally independent of the other lens. Therefore, each compensating lens provides correction for a different type of image distortion and is adjusted for optimum performance without affecting the adjustment or performance of the other lens.

The lens system of the present invention is different in both function and implementation from that described in the Albertin, et al. patent. Albertin, et al. use a quadrupole lens which performs only scan expansion. A separate dome-shaped electrode is added to accelerate the electrons toward the display screen. On the other hand, in the present invention, an electrostatic lens of the quadrupole type having coaxial tubular electrodes wherein a larger diameter electrode overlaps the contoured end of a smaller diameter electrode performs simultaneously both functions of electron acceleration and electron beam scan expansion.

The compensating lens mechanisms of Albertin, et al. and the present invention utilize entirely different methods to correct image distortion introduced by the entirely different lens systems. Albertin, et al. makes use of slot lens electrodes on the front and rear ends of the scan expansion quadrupole lens to correct for the combined effects of scan nonlinearity and geometry distortion in the vertical and horizontal, respectively, dimensions of the display. The compensating lens mechanism performs its task by converging in the vertical direction the electron beam at the aperture of the first slot electrode prior to its emergence from the dome-shaped acceleration electrode. Further, interaction between the two lens makes adjustment and performance of one lens dependent on the other lens.

In the present invention, each compensating lens is dedicated to a particular distortion mechanism and is separate from and independent of the other compensating lens. In addition, unlike the compensating mechanism in Albertin, et al., it is essential that the compensating lens mechanism of the present invention converge the electron beam prior to its entry into the aperture of the exit lens electrode to provide for corrected geometry of the image.

Additional objects and advantages of the present invention will be apparent from the following detailed description of a preferred embodiment thereof which proceeds with reference to the accompanying drawings.

PREFERRED EMBODIMENT OF THE INVENTION

Figure 1:
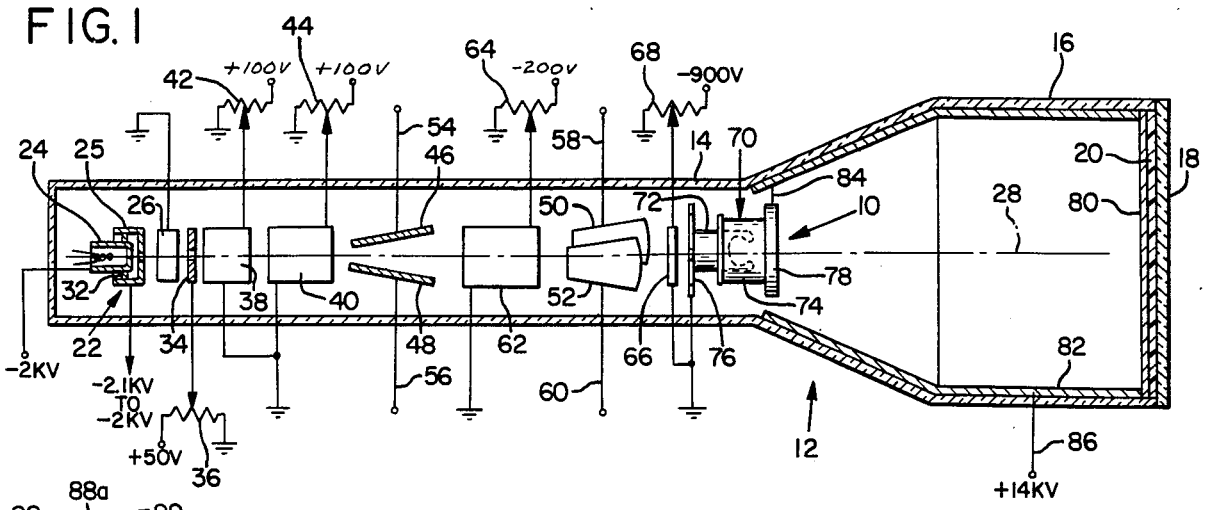
FIG. 1 is a schematic longitudinal section view of a cathode ray tube incorporating the post-deflection accelerating and scan expansion lens system of the present invention.

With reference to FIG. 1, an electron beam accelerating and scan expansion lens system 10 in accordance with the present invention is contained within the evacuated envelope of cathode ray tube 12 for a cathode ray oscilloscope. The envelope includes tubular glass neck 14, ceramic funnel 16, and transparent glass face place 18 sealed together by devitrified glass seals as taught by U.S. Pat. No. 3,207,936 of Wilbanks, et al. A layer 20 of a phosphor material is coated on the inner surface of face plate 18 to form the fluorescent screen for the cathode ray tube.

Electron gun 22 including cathode 24, control grid 25, and anode 26 is supported inside neck 14 at the end of the tube opposite the fluorescent screen to produce a beam of electrons directed generally along beam axis 28, which is coincident with the central longitudinal axis of the tube, toward the fluorescent screen. A DC voltage source of approximately −2 kv is connected to cathode 24 and the electrode beam emitted from such cathode is accelerated toward anode 26 which is connected to ground potential. Cathode 24 is supported within and is electrically isolated from the control grid electrode 25 by ceramic spacer member 32. Grid 25 is at a more negative voltage of about −2.1 kv than the cathode to control the number of electrons passing to the anode 26 and thereby vary the intensity of the electron beam.

The electron beam passes through an aperture in anode 26 toward stigmator lens 34, which is connected to the movable contact of potentiometer 36 to provide a beam astigmatism correction adjustment of between 0 and +50 v.

Figure 2:
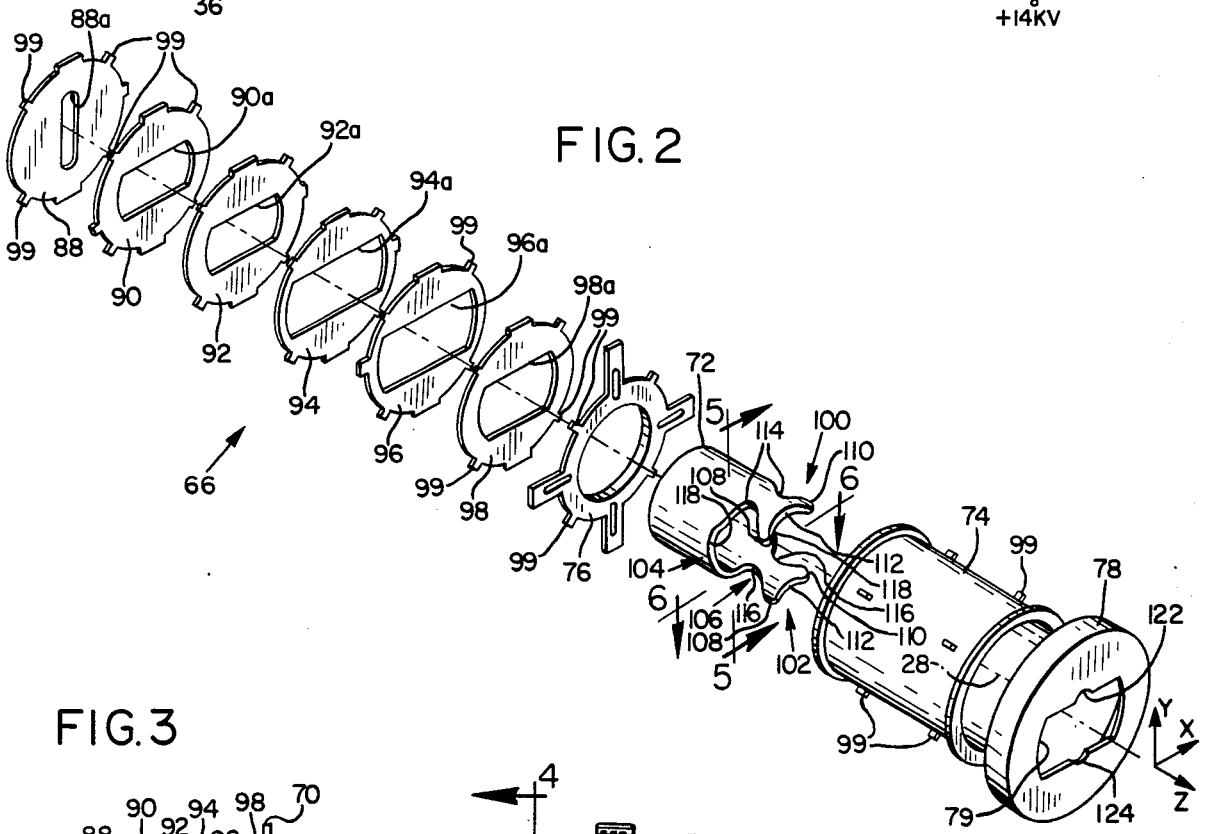
FIG. 2 is an exploded view showing the components of the lens system in the cathode ray tube of FIG. 1.

A focusing lens system preferably of the type disclosed in U.S. Pat. Nos. 4,137,479 and 4,188,563 of Janko is disposed adjacent the output of stigmator lens 34 and includes first quadrupole lens 38 and second quadrupole lens and 40. Quadrupole lens 38 converges the electron beam in the X-Z plane and diverges it in the Y-Z plane; whereas, quadrupole lens 40 diverges the electron beam in the X-Z plane and converges it in the Y-Z plane. The coordinate axes X, Y, and Z to which reference herein is made are shown in FIG. 2 and include a horizontal axis X, a vertical axis Y, and a beam axis Z. The movable contacts of potentiometers 42 and 44 are connected to quadrupole lenses 38 and 40, respectively, to provide the focus adjustment of between 0 and +60 v.

The electron beam strikes the fluorescent screen and forms a light image thereon after the beam is deflected by the deflection means which changes the position of the beam on the screen. The deflection means includes vertical deflection plates 46 and 48, preferably of the type described in U.S. Pat. No. 4,093,891 of Christie, et al., and horizontal deflection plates 50 and 52. Deflection plates 46 and 48 deflect the beam in the vertical direction in response to a vertical deflection signal, which is applied to neck pins 54 and 56. Deflection plates 50 and 52 deflect the beam in the horizontal direction in response to a horizontal deflection signal, which is the ramp voltage output of a conventional time base sweep circuit and is applied to neck pins 58 and 60.

A third quadrupole lens 62 preferably of the type disclosed in U.S. Pat. Nos. 4,137,479 and 4,188,563 of Janko is interposed between the vertical and horizontal deflection plates 46, 48 and 50, 52, respectively, along the path of the deflected electron beam to provide a scan expansion lens which converges the electron beam in the X-Z plane and diverges it in the Y-Z plane. This lens increases the amount of vertical deflection produced by the deflection plates 46 and 48 in response to the applied vertical deflection signal. The movable contact of potentiometer 64 is connected to third quadrupole lens 62 to change the degree of magnification or scan expansion produced by the lens by adjusting its voltage between 0 and −200 v.

The accelerating and scan expansion lens system 10, which comprises three separate lenses, is positioned adjacent to and downstream of horizontal deflection plates 50 and 52. The first lens of lens system 10 includes slot lens means 66 which comprises six slotted electrodes, each having a slot aperture positioned symxetrically about beam axis 28. Potentiometer 68 provides on its movable contact an adjustable voltage of between 0 and −900 v which is applied to certain electrodes of lens 66 to produce electric field flux lines that extend through the electrode apertures. Adjusting the voltage on the movable contact of potentiometer 68 changes the shape and distribution of the flux lines which influence the direction of electron beam travel as will be further hereinafter described.

The second lens of lens system 10 is accelerating and scan expansion lens means 70 that includes inner tubular electrode 72, which is in coaxial relation with and enclosed in part by outer tubular electrode 74. Both electrodes 72 and 74 have generally cylindrical shapes in the preferred embodiment of the invention. Cross-shaped support ring 76 is mounted at the front end of inner electrode 72 and is positioned immediately adjacent the output electrode of slot lens means 66. Ring 76 is secured to four glass mounting rods 77 (FIG. 4) and provides the support for inner tubular electrode 72 so that the axis of the electrode is aligned coincident with beam axis 28.

The third lens of lens system 10 is an exit lens means 78 that includes a single apertured electrode of a cap shape which has a slot aperture 79 symmetrically disposed with respect to beam axis 28. Lens means 78 is mounted on and extends over a portion of the rear end of outer tubular electrode 74 to provide corrected geometry of the image displayed on the fluorescent screen.

The electrons in the electron beam are accelerated by a high potential electrostatic field and strike the display screen at a high velocity. This post-deflection acceleration field is produced between inner tubular electrode 72 and outer tubular electrode 74, as well as envelope wall coatings 80 and 82. One such wall coating is a thin, electron transparent aluminum film 80 that overlays phosphor layer 20. Film 80 is connected to an electrically conductive layer 82 deposited on the inner surface of funnel 16. Conductive layer 82 terminates just beyond exit lens means electrode 78 and is connected to such electrode by conducting lead 84. Conductive layer 82 is connected through feed-through connector 86 to an external high voltage DC source of approximately +14 kv relative to inner electrode 72 which is connected to ground potential through cross-shaped ring 76. The potential difference developed across inner electrode 72 and outer electrode 74 changes the direction of the electron beam traveling through the opening in inner electrode 72 to converge the electron beam in the Y-Z plane and diverge it in the X-Z plane. Thus, the coaxial electrodes 72 and 74 perform the dual functions of accelerating the electrons in and expanding the deflection angle of the electron beam.

Figure 3:
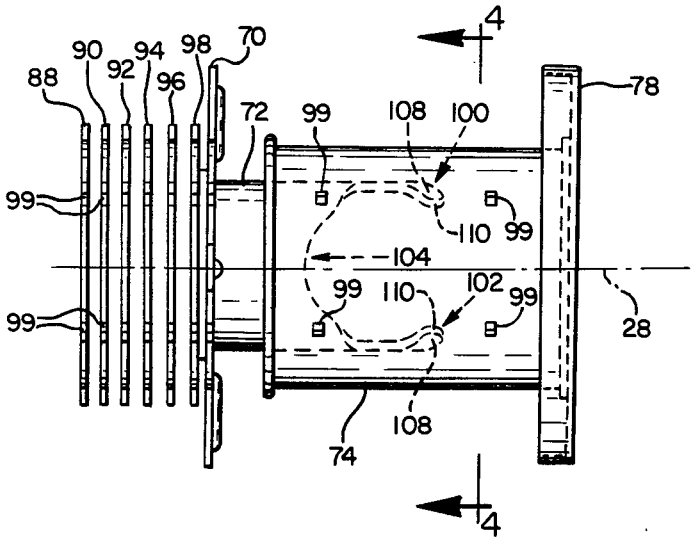
FIG. 3 is an enlarged side elevation view of the lens system of FIGS. 1 and 2 with portions of the inner and outer tubular electrodes shown in phantom.
Figure 4:
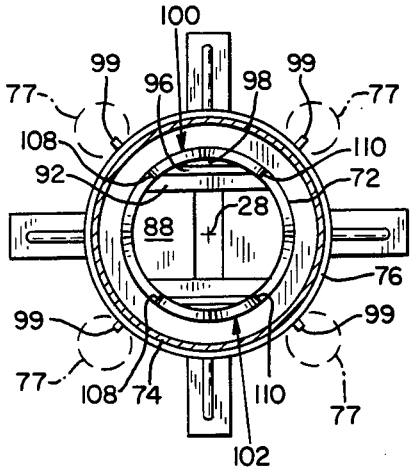
FIG. 4 is a vertical section view taken along line 4—4 of FIG. 3 with the mounting rods shown in phantom.

With reference to FIGS. 2–4, slot lens means 66 includes six slot electrodes 88, 90, 92, 94, 96, and 98 which are closely spaced-apart, substantially flat wafers having apertures symmetrically aligned about beam axis 28. Tab portions 99 of the slot electrodes are bonded into glass rods 77 to maintain the spacing between adjacent electrodes and the alignment of the apertures. Tab portions 99 also extend from outer electrode 74 and ring 76 and are bonded into glass rods 77 to maintain the coaxial alignment of electrodes 72 and 74. Input slot electrode 88 has a vertically disposed oblong slot **88*a* which receives the electron beam after it has been deflected by horizontal deflection plates 50 and 52. The remaining five slot electrodes 90, 92, 94, 96, and 98 have horizontally disposed slots, the opposite short sides of which are concave as viewed from the interior of the slot. Slot electrodes 90 and 92 have identical apertures, 90*a* and 92*a*, respectively; and the remaining slot electrodes 94, 96, and 98 have slot apertures 94*a*, 96*a*, 98*a*, respectively, of varying vertical widths. The graduated size openings in slot lens means 66 produced by the varying widths of the aligned slot electrode apertures is best seen in FIG. 4**.

Electrode 96 is connected to the movable contact of potentiometer 68 which provides a negative potential thereto. Electrodes 88, 92, 94, and 98 are connected to ground potential. Electrode 90 is connected to a +50 volt source (not shown). The dimensions of the apertures of the slot electrodes and the magnitude and distribution of the voltage applied to certain ones of the electrodes determine the characteristics of the electric field flux lines so as to provide a force directed slightly toward beam axis 28 on an electron beam which has been deflected to a great degree. Since the electric field flux lines in the space proximate the central portion of the opening of slot lens means 66 are approximately parallel to beam axis 28, electron beams experiencing a moderate amount of or no appreciable deflection are not influenced by the electric field of lens means 66. Lens means 66 constitutes a first compensating lens that in communication with accelerating and scan expansion lens means 70 produces a compensating electric field to linearize the vertical scan expansion provided by accelerating and scan expansion lens means 70.

The electron beam exits output slot electrode 98 of lens means 66 and enters at the front end of inner tubular electrode 72 of accelerating and scan expansion lens means 70. The very high electrostatic potential applied between electrodes 72 and 74 attracts the electrons in the beam toward outer tubular electrode 74, thereby magnifying the amount of electron beam deflection or scan produced by the deflection means. Since the electric field flux lines near the inner surface of electrode 72 are not uniformly shaped, the scan magnification is not linear for electron beams deflected to a great degree. However, accelerating and scan expansion lens means 70 and slot lens means 66 cooperate to provide linear magnification of the deflected electron beam by applying compensating forces on electron beams deflected into the region.

It should be understood that the coaxial accelerating and scan expansion lens is not a pure quadrupole lens. In addition to its predominant quadrupole action, lens means 70 has an octupole moment that produces defocusing of the electron beam in a vertical plane. The effect of this defocussing is to produce a horizontal ellipse rather than a circular spot at the fluorescent screen, with the length of the ellipse increasing as the beam is deflected away from beam axis 28. The distortion produced by the octupole moment of lens means 70 is corrected by electrode 90 which, together with input slot electrode 88, provides a compensating octupole action at the entrance to slot means 66. The magnitude of the correction depends on the potential applied to electrode 90 relative to adjacent electrodes 88 and 92, which are at ground potential. Additional correction may be provided by operating quadrupole lens 62 in such a manner that it has a compensating octupole moment.

Figure 5:
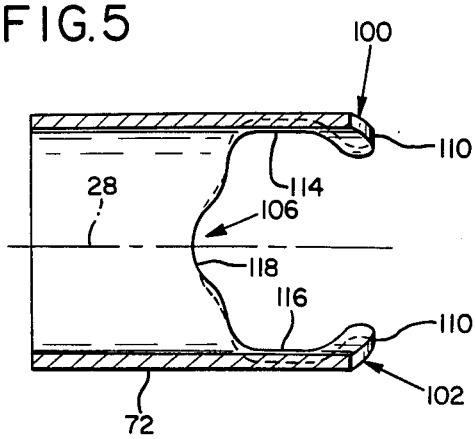
FIG. 5 is an enlarged vertical section view taken along line 5—5 of FIG. 2 showing one of the pair of concave sections on the inner tubular electrode.
Figure 6:
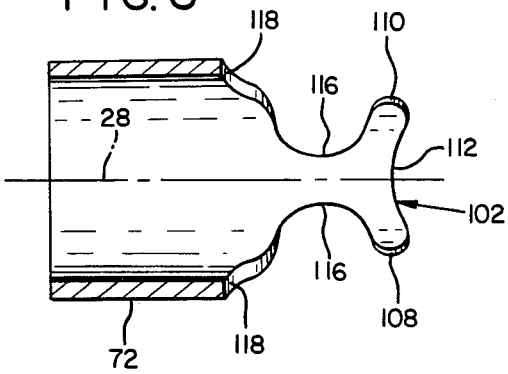
FIG. 6 is an enlarged horizontal section view taken along line 6—6 of FIG. 2 showing one of the pair of protrusions on the inner tubular electrode.

With reference to FIGS. 2–6, the end of the inner electrode 72 which is enclosed in part by outer electrode 74 has a pair of opposed projections 100 and 102 of substantially similar shape on opposite sides of beam axis 28. Opposed projections 100 and 102 are separated on either side by and aligned transversely of a pair of opposed curvilinear portions 104, 106 of substantially similar shape. Thus, the partly enclosed end of electrode 72 is characterized as having twofold symmetry. The first region of symmetry lies on either side of the Y-Z vertical reference plane coincident with beam axis 28. The portion lying on the right side of the plane is shown in FIG. 5. The second region of symmetry lies on either side of the X-Z horizontal reference plane coincident with beam axis 28. The portion lying below the plane is shown in FIG. 6.

Each projection 100 and 102 has a pair of lobes 108 and 110 which are separated by a concave portion 112 to provide symmetrical projections. The lobes are formed by machining away portions of the end of a cylindrical tubular member; therefore, the inner and outer surfaces are shaped in accordance with the contour of the cylindrical surface of electrode 72.

Curvilinear portion 104 separates the two lobes 108, and curvilinear portion 106 separates the two lobes 110 of the opposed projections 100 and 102. Each curvilinear portion is comprised of three concave sections 114, 116, and 118 including two side sections 114 and 116 separated by a middle section 118. The precise shape of the contour of the lobes and curvilinear portions is determined empirically and is dictated by the electric field flux line pattern required to perform linear magnifications of the deflected electron beam. In general, however, the horizontal linearity of the lens system is determined by the shape and length of lobes 108 and 110. (As mentioned above, the slot lens 66 corrects vertical linearity.) It will thus be appreciated that the lens system of the invention allows independent correction of horizontal and vertical linearity.

The diameter of inner electrode 72 determines the extent of magnification produced and thereby the focal length of the accelerating and scan expansion lens. Therefore, the required electric field flux line pattern is controlled primarily by the diameter of electrode 72. The particular shape of the contoured rear end of electrode 72 shown in the drawings pertains to an inner electrode having an inner diameter of 1.65 centimeters and an outer diameter of 1.905 centimeters.

Sufficient spacing between the outer surface of inner electrode 72 and the inner surface of outer electrode 74 is critical to the extent that dielectric breakdown in the air gap therebetween does not occur at operating voltages and that the electric field flux lines near inner electrode 72 remain undisturbed. In both instances, a greater separation is required as the potential difference between the two electrodes is increased.

As shown best by the phantom lines in FIG. 5, the contoured edge of inner electrode 72 including the opposed projections and curvilinear portions are beveled to smooth its surface and eliminate sharp edge points thereby preventing field emission of electrons therefrom. A thickness of 0.150 centimeters for inner electrode 72 is adequate to provide an acceptable beveled edge.

Figure 7:
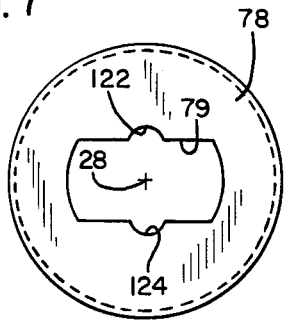
FIG. 7 is an end elevation view of the right end of FIG. 3 showing the slot and cutout portions along the edges of the exit lens electrode.

With reference to FIGS. 2, 3, and 7, the exit lens means formed by electrode 78 has a horizontally disposed slot aperture 79, the opposite short sides of which are concave as viewfrom the interior of the aperture. Opposed arcuate cutout portions or notches 122 and 124 are provided in the longer top and bottom sides symmetrically aligned on opposite sides of central longitudinal axis 28. Electrode 78 is mounted directly to the rear end of outer electrode 74 and connected by conducting lead 84 to the conductive wall coating 82 which is raised to a potential of +14 kv. Notches 122 and 124 alter the character of the electric field flux lines developed between inner electrode 72 and outer electrode 74 so as to provide corrected geometry for the resultant displayed light image. The notches 122 and 124, which in the preferred embodiment are of arcuate shape but can be formed in other shapes, produce electric field flux lines that fluctuate moderately to compensate for the similar but oppositely phased fluctuation characterizing the electric field flux lines produced by the potential difference between electrodes 72 and 74. The dimensions and shape of slot aperture 79 and the notches 122 and 124 therein are the parameters which are adjusted to eliminate pin cushion geometry distortion of the image displayed on the fluorescent screen. Thus, the exit lens means 78 constitutes a second compensating lens that in communication with accelerating and scan expansion lens means 70 provides a compensating electric field flux line pattern to eliminate geometry distortion of the displayed image.

It will be obvious to those having skill in the art that many changes may be made in the above-described details of the preferred embodiment of the present invention. Therefore, the scope of the present invention should be determined only by the following claims.

We claim:

1. In an electron discharge tube having an electron gun positioned at one end of the tube for producing a beam of electrons directed along a beam axis in the tube and deflection means for deflecting the electron beam to form an image, an electrostatic lens system positioned downstream of the deflection means along the beam axis and comprising:

slot lens means including a plurality of apertured electrodes having slots symmetrically aligned about the beam axis;

accelerating and scan expansion lens means including two aligned cooperating electrodes supported downstream of the slot means to provide in cooperation with the slot lens means a linear magnification of the amount of electron beam deflection produced by the deflection means; and an exit lens means including a lens electrode supported adjacent the output of the accelerating and scan expansion lens means, the lens electrode having a slot aperture through which the beam travels and having means to receive a fixed potential to produce in the vicinity of the lens electrode electric field flux lines that change the direction of the beam in a manner that provides corrected geometry of the image.

2. The lens system in accordance with claim 1 in which the electrodes of the slot lens means comprise spaced-apart substantially flat wafers, at least some of the wafers having applied thereto voltages which produce an electric field that influences the direction of the electron beam traveling through the apertures so as to linearize the magnification of the accelerating and scan expansion lens means.

3. The lens system in accordance with claim 1 in which the two aligned cooperating electrodes of the accelerating and scan expansion lens means include overlapping coaxial inner and outer tubular lens electrodes of different diameters, the inner tubular electrode having at one end thereof a pair of opposed projections on opposite sides of the beam axis, the projections being aligned transversely of opposed concave surfaces on the one end of the inner electrode, and the outer tubular electrode comprising a cylinder which extends over the opposed projections of the inner electrode.

4. The lens system in accordance with claim 3 in which the one end of the inner tubular electrode includes two curvilinear portions, each portion having three concave sections and being positioned between adjacent sides of the pair of projections to separate each projection from the other, each projection comprising a pair of lobes with one lobe being separated from the other lobe of the pair by a concave portion on the one end of the inner tubular electrode.

5. The lens system in accordance with claim 4 in which the profile of the one end of the inner tubular electrode is symmetrical about first and second reference planes substantially perpendicular to each other, the first plane being positioned coincident with the axis of the lens electrodes and aligned with the one end of the inner electrode so as to bisect the curvilinear portions separating the opposed projections to form a first pair of regions wherein each region includes one projection and is the mirror image of the other region, and the second plane intersects the first plane orthogonally along the axis of the lens electrodes so as to bisect the symxetrical concave portions separating the pair of lobes of each projection to form a second pair of regions wherein each region includes the adjacent lobes of the pair of projections and one of the curvilinear portions and is the mirror image of the other region.

6. The lens system in accordance with claim 5 in which the axis of the lens electrodes is coincident with the beam axis.

7. In an electron discharge tube having an electron gun positioned at one end of the tube for producing a beam of electrons directed along a beam axis in the tube and deflection means for deflecting the electron beam to form an image, an electrostatic lens system positioned downstream of the deflection means along the beam axis and comprising:

slot lens means including a plurality of apertured electrodes having slots symmetrically aligned about the beam axis;

accelerating and scan expansion lens means including two aligned cooperating electrodes supported downstream of the slot lens means to provide in cooperation with the slot lens means a linear magnification of the amount of electron beam deflection produced by the deflection means; and exit lens means including a lens electrode supported adjacent the output of the accelerating and scan expansion lens means and having a slot aperture to provide corrected geometry of the image, the slot aperture of the exit lens means electrode having a pair of aligned notch portions in the edge of the slot aperture on opposite sides of the beam axis.

8. A cathode ray tube comprising:

an electron gun means to produce a beam of electrons directed along a beam axis in the tube;

deflection means to deflect the beam relative to the beam axis to produce an image on the fluorescent screen of the tube; and an electrostatic lens means positioned downstream of the deflection means and including an accelerating and scan expansion lens means disposed between a slot lens means and an exit lens means, the exit lens means including means to receive a fixed potential to develop in the vicinity thereof electric field flux lines, and the accelerating and scan expansion lens means including a pair of aligned cooperating tubular electrodes in cooperation with the slot lens means to provice a linear magnification of the amount of deflection produced by the deflection means and to accelerate the electrons in the deflection beam, and in cooperation with the exit lens means so that the electrice field flux lines in the vicinity of the exit lens means produce a change in the direction of the beam in a manner to provide corrected geometry of the image.

9. The tube in accordance with claim 8 in which the slot lens means includes a plurality of electrodes having slot apertures symmetrically aligned about the beam axis.

10. The tube in accordance with claim 9 in which the electrodes of the slot lens means comprise spaced-apart substantially flat wafers, certain ones of the wafers having applied thereto voltages that produce a compensating electric field in the vicinity of the apertures to correct for nonlinear magnification by the accelerating and scan expansion lens means.

11. The tube in accordance with claim 8 in which the pair of aligned tubular electrodes of the accelerating and scan expansion lens means include coaxial inner and outer tubular electrodes of different diameters, the inner electrode having a contoured end which extends into the outer electrode, the contoured end comprising a pair of projections disposed face-to-face on opposite sides of the beam axis and a pair of curvilinear portions positioned between adjacent sides of the pair of projections to separate each projection from the other.

12. The tube in accordance with claim 8 in which the exit lens means is supported downstream of the output of the accelerating and scan expansion lens means and includes an exit lens electrode having an aperture through which the electron beam travels.

13. A cathode ray tube comprising:

electron gun means to produce a beam of electrons directed along a beam axis in the tube;

deflection means to deflect the beam relative to the beam axis to produce an image on the fluorescent screen of the tube; and electrostatic lens means positioned downstream of the deflection means and including an accelerating and scan expansion lens means disposed between a slot lens means and an exit lens means, the accelerating and scan expansion lens means including a pair of aligned cooperating tubular electrodes in cooperation with the slot lens means to provide a linear magnification of the amount of deflection produced by the deflection means and to accelerate the electrons in the deflected beam, and in cooperation with the exit lens means to provide corrected geometry of the image, the exit lens means being supported downstream of the output of the accelerating and scan expansion lens means and including an exit lens electrode having an aperture through which the electron beam travels and aligned notches in the edge of the aperture on opposite sides of the beam axis.

14. A cathode ray tube comprising:

an electron gun means to produce a beam of electrons directed along a beam axis in the tube;

deflection means to deflect the beam relative to the beam axis to produce an image on the fluorescent screen of the tube;

an accelerating and scan expansion lens means positioned downstream of the deflection means to magnify the amount of electron beam deflection produced by the deflection means and to accelerate the electrons in the deflected electron beam; and first and second compensating lenses in communication with the accelerating and scan expansion lens means, the first compensating lens being positioned adjacent the input of the accelerating and scan expansion lens means to correct for nonlinear magnification of electron beam deflection and the second compensating lens being positioned adjacent the output of the accelerating and scan expansion lens means to correct for geometry distortion of the image, the first compensating lens having substantially no effect on the correction by the second compensating lens for geometry distortion of the image and the second compensating lens having substantially no effect on the correction by the first compensating lens for nonlinear magnification of electron beam deflection.

15. The tube in accordance with claim 14 in which the accelerating and scan expansion lens means includes a pair of aligned tubular electrodes.

16. The tube in accordance with claim 14 in which the first compensating lens includes a plurality of apertured slot electrodes having slots symmetrically aligned about the beam axis.

17. The tube in accordance with claim 14 in which the second compensating lens includes an exit lens electrode having an aperture disposed symmetrically with respect to the beam axis.

18. A cathode ray tube comprising:

electron gun means to produce a beam of electrons directed along a beam axis in the tube;

deflection means to deflect the beam relative to the beam axis to produce an image on the fluorescent screen of the tube;

accelerating and scan expansion lens means positioned downstream of the deflection means to magnify the amount of electron beam deflection produced by the defection means and to accelerate the electrons in the deflected electron beam; and first and second compensating lenses, each of the compensating lenses being frictionally substantially independent of the other lens and in communication with the accelerating and scan expansion lens means, the first compensating lens being positioned adjacent the input of the accelerating and scan expansion lens means to correct for nonlinear magnification of electron beam deflection and the second compensating lens being positioned adjacent the output of the accelerating and scan expansion lens mens to correct for geometry distortion of the image, the second compensating lens including an exit lens electrode having an aperture disposed symmetrically with respect to the beam axis and a pair of aligned notches in the edge of the aperture on opposite sides of the beam axis.

* * * * *